United States Patent [19]

Sekine et al.

[11] 4,320,479

[45] Mar. 16, 1982

[54] ANALOGUE ELECTRONIC TIMEPIECE WITH AN ALARM DEVICE

[75] Inventors: Mitsuo Sekine, Tokorozawa; Yasuhiko Nishikubo, Iruma, both of Japan

[73] Assignee: Citizen Watch Co., Ltd., Tokyo, Japan

[21] Appl. No.: 185,872

[22] Filed: Sep. 9, 1980

Related U.S. Application Data

[63] Continuation of Ser. No. 390, Dec. 29, 1978, abandoned.

[51] Int. Cl.[3] ..... G04B 27/08

[52] U.S. Cl. ..... 368/74; 368/73; 368/80; 368/251

[58] Field of Search ..... 368/72, 73, 74, 80, 368/251, 250

[56] References Cited

U.S. PATENT DOCUMENTS

| | | | |
|---|---|---|---|
| 3,759,029 | 9/1973 | Komaki | 368/72 |
| 3,911,665 | 10/1975 | Van Berkum | 368/80 |
| 4,074,516 | 2/1978 | Kondo | 368/73 |
| 4,196,583 | 4/1980 | Komaki | 368/251 X |

*Primary Examiner*—B. A. Reynolds
*Assistant Examiner*—Bernard Roskoski
*Attorney, Agent, or Firm*—Birch, Stewart, Kolasch & Birch

[57] ABSTRACT

An analogue electronic timepiece is described having an oscillator, a frequency divider, a hand display means, an hour and minute circuit for counting the output of the frequency divider, and an alarm setting circuit. An equality checking circuit adapted to compare the output of the hour and minute circuit with the output of the alarm setting circuit to produce a coincidence signal. An alarm device is operated by the coincidence signal, gate means, and a manual switch. The gate means is so arranged to produce a signal for setting an alarm time in the alarm setting circuit in accordance with the closing of the switch.

9 Claims, 4 Drawing Figures

ANALOGUE ELECTRONIC TIMEPIECE WITH AN ALARM DEVICE

This application is a continuation of copending application Ser. No. 390, filed on Dec. 29, 1978, now abandoned.

BACKGROUND OF THE INVENTION

The present invention relates to an analogue electronic timepiece with an alarm means which operates to actuate the alarm device such as buzzer or light emitting diode (LED) after an elapsed time.

In the conventional analogue electronic watch with the alarm means, the setting of the alarm is performed with the aid of the alarm hand. Since there is an error in the position of the alarm hand, it is difficult to set an exact alarm time.

SUMMARY OF THE INVENTION

It is an object of the present invention to provide an analogue electronic timepiece with an alarm means in which alarm time of an elapsed time may be accurately set with ease.

According to the present invention, there is provided an analogue electronic timepiece with an elapsed time alarm means comprising an hour and minute circuit including means for counting the output of said frequency divider to generate an elapsed time signal, an alarm setting circuit including means for memorizing input signals, an equality checking circuit connected to said hour and minute circuit and said alarm setting circuit and adapted to produce an output signal when the time signal coincides with the output signal of said alarm setting circuit, and an alarm device adapted to be operated by the output signal of said equality checking circuit. The alarm circuit further includes gate means connected to said frequency divider, hour and minute circuit, alarm setting circuit and alarm device, and a manually operated switch connected to said gate means, said gate means being so arranged to actuate said hour and minute circuit, alarm setting circuit and alarm device by controlling the output of said frequency divider in accordance with mode of signal produced by operating said switch.

Further objects, features and advantages of the present invention will become apparent from the following description in conjunction with the accompanying drawings.

DESCRIPTION OF THE PREFERRED EMBODIMENT

Figure 1:
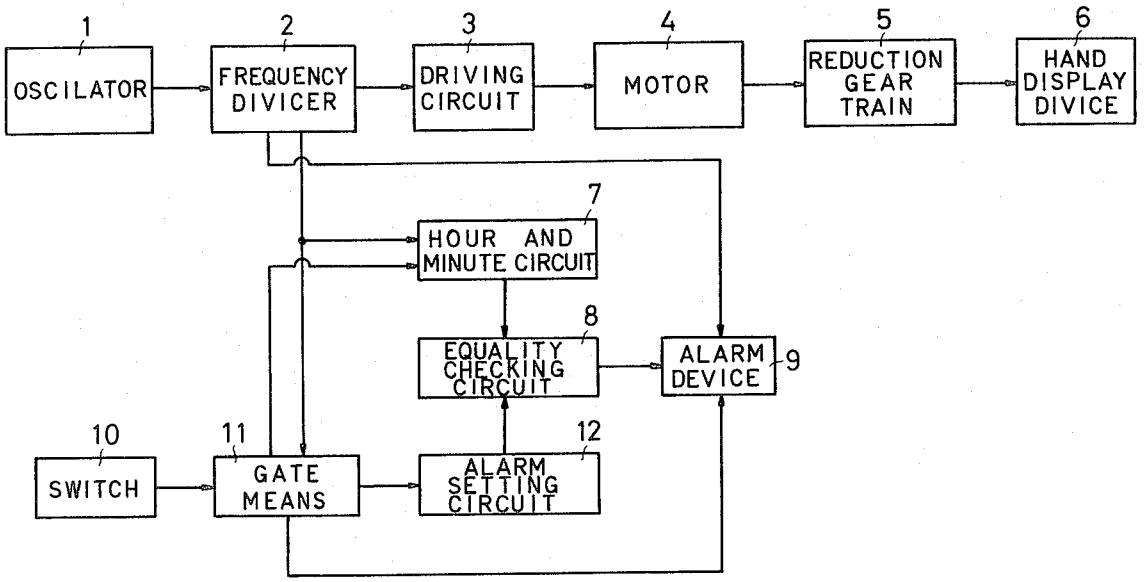
FIG. 1 is a block diagram showing an analogue electronic timepiece with an alarm means according to the present invention.

Referring to the drawings, FIG. 1 shows an embodiment of the present invention, which includes a conventional analogue electronic timepiece comprising a crystal controlled oscillator 1, a frequency divider 2, a driving circuit 3, a motor 4, a reduction gear train 5 and a hand display device 6. In accordance with the present invention, the electronic timepiece further comprises an hour and minute circuit 7, an equality checking circuit 8, an alarm device 9, a switch 10, a gate means 11 and an alarm setting circuit 12. The hour and minute circuit 7 includes counters connected to the frequency divider 2 and is adapted to generate an hour and minute signal. The gate means 11 is provided to control the signals from the switch 10 and frequency divider to the hour and minute circuit 7, alarm setting circuit 12 and alarm device 9. The equality checking circuit 8 operates to produce the alarm signal, when the time signal from the hour and minute circuit 7 coincides with the alarm time signal from the alarm setting circuit 12.

The switch 10 comprises a single actuating member and is adapted to be operated manually to produce various modes of signal. The gate means 11 is so arranged to control each circuit in accordance with the mode of the signal from the switch 10. For example, by turning on the switch for a predetermined period or by turning on the switch several times for a predetermined period, the alarm setting circuit 12 is turned to the alarm set enabling state under which the alarm time can be set. To set the alarm time in the alarm set enabling state, the switch 10 is actuated suitable times for setting a desired elapsed alarm time. For example, in the case that the alarm setting circuit is so arranged that one turn-on of the switch provides one minute alarm setting, if the switch is turned on five times, five minutes for alarm may be set. At this time, the hour and minute circuit is automatically reset for a predetermined time, after which starts to count the pulse from the frequency divider 2.

The present invention will be more fully explained hereinafter with reference to FIG. 2. The hour and minute circuit 7 comprises a 1/60 counter 13 for dividing the 1 second signal applied from the frequency divider 2 to 1 minute signal, a 1/5 counter 14 for dividing the 1 minute signal to 5 minute signal, and a 1/16 counter 15 for dividing the 5 minute signal to 80 minute signal. The alarm setting circuit 12 has a same structure as the 1/16 counter 15. The equality checking circuit 8 comprises exclusive-OR gates 16, 17, 18 and 19 for comparing the content in the 1/16 counter 15 with the content in the alarm setting circuit 12, a gate for inhibiting the alarm operation, when the content in the alarm setting circuit 12 is zero, a gate 21 for detecting the time when the content in the 1/16 counter 15 coincides with the content in the alarm setting circuit 12, an inverter 22, and a flip-flop 23. From FIG. 2, it will be understood that the alarm time in the range between 5 minutes and 75 minutes may be set in intervals of 5 minutes. To inhibit the alarm operation, the alarm setting circuit 12 is reset. The flip-flop operates to control the alarm operating period, and in this embodiment, the period of time is within 1 minute.

In the gate means 11 in the initial state, outputs Q32 and Q33 of flip-flops are low level (hereinafter called as L), as a result a flip-flop 41 is in reset state and the output Q41 is L. Further, output 340 of a gate 34 is high level (hereinafter called as H) and output of an inverter 47 is L. Output B of SR flip-flop comprising gates 36 and 37 is H and output C of SR flip-flop comprising gates 43 and 44 is H. Output E of SR flip-flop comprising gates 48 and 49 is L and output $\overline{E}$ thereof is H. Since the output of the gate 34 is H, the hour and minute circuit 7 and the alarm setting circuit 12 are released from the reset state. From these conditions, output 460 of an inverter 46 is L, output 450 of a gate 45 is L, output 500 of a gate 50 is H and output 510 of an inverter 51 is L. It should be noted that each of signals 1 Hz, 2 Hz and 4 Hz applied to the circuit has the duty cycle of 50%.

Under such conditions, when the switch 10 is thrown to make the contact A, the output Q32 of the flip-flop 32 becomes H on the negative-going transition of the 4 Hz signal. When the output Q32 has changed to H, the output of the inverter 35 had changed to H. Accordingly, the output B of the SR flip-flop comprising the gates 36, 37 is still in H level. When 4 Hz signal changes from L to H, the output B becomes L. On the other hand, the output B immediately goes to H, when the output Q32 changes from H to L by the 4 Hz signal. The inverter 46 produces a signal of 8 Hz, that is 125 ms, on the output 460 according to the outputs Q32 and B, when the switch 10 is closed. If the switch 10 is held in the closed state, the flip-flop 33 is triggered by the 1 Hz signal to cause the change of the output Q33 to H. Therefore, the gate 34 turns on and the flip-flop 41 is released from the reset state. Thus, the flip-flop 41 is operated by the 1 Hz signal resulting the change in the output Q41 to H. The output 340 of the gate 34 will change from H to L after 1.5 second from triggering of the flip-flop 33. The output 340 is 1 Hz$\times\frac{1}{2}$ cycle, i.e. 500 ms signal. The hour and minute circuit 7 and the alarm setting circuit 12 are reset by the output 340, so that the 1 minute output of the 1/60 counter 13 becomes L. When the output 340 changes to H, the hour and minute circuit 7 starts to operate and the SR flip-flop comprising the gates 43 and 44 operates causing the change in the output C to L. At that time, since the output Q33 of the flip-flop 33 is H, the output 450 of the gate 45 is held still in L. When the switch 10 is opened, the output Q33 of the flip-flop 33 goes to L, whereby the output 450 of the gate 45 goes to H and the output E of the SR flip-flop comprising gates 48 and 49 becomes H, and the output $\overline{E}$ becomes L. Accordingly, the flip-flop 41 is changed to the reset state by the output $\overline{E}$ of L irrespective of the output Q33 of the flip-flop 33. On the other hand, the gate 50 turns on according to the output E of H. Since the gate turns on after the switch 10 having been turned off, the output 460 of 125 ms is not generated and hence not applied to the gate 50. Therefore, the alarm setting circuit 12 is not operated. Thereafter, if the switch 10 is closed several times, the output 450 of 125 ms is generated at every closings of the switch and applied to the alarm setting circuit 12 through the gate 50 to perform the setting of alarm.

When the 1 minute signal from counter 13 changes from L to H, the output 420 of the inverter 42 becomes L and the SR flip-flop comprising the gates 43 and 44 becomes H. At the same time, the SR flip-flop comprising the gates 48 and 49 is operated by the 1 minute signal, so that the output $\overline{E}$ goes to H and the output E goes to L to thereby turn off the gate 50. Thus, the alarm setting operation is finished.

Now describing about the alarm device 9, the 2 Hz signal, the output 240 of inverter 24 which is inverted 1 Hz, the output Q23 of the flip-flop 23 and the output 520 of inverter 52 are applied to the gate 26. Applied to the gate 27 are the output of the gate 26, the output 510 of the inverter 51, and the output 470 of the inverter 47. The output of the gate 27 and 2048 Hz signal derived from the frequency divider 2 are applied to the gate 28. The output 280 of the gate 28 is applied to the driver 30 through the inverter 29 to actuate the alarm 31 such as buzzer.

When the output Q23 of the flip-flop 23 is L and outputs 510 and 470 are L, the output 270 of the gate 27 is H, to thereby turn off the gate 28. Accordingly, the alarm is not operated. Under such a condition, if the switch 10 is closed for a while as set forth above, the output 340 of the gate 34 becomes L of 500 ms and the output 470 of the inverter 47 goes to H. Thus, the output 270 of the gate 27 becomes L and the gate 28 is turned on, so that the 2048 Hz signal generates on the output 280 to thereby actuate the alarm. Accordingly, the operator is informed that the watch is in alarm set enabling state.

Thereafter, when the switch 10 is closed suitable times, the alarm time is set and the output 510 of the inverter 52 becomes H of 125 ms as set forth above. The output 510 changes the output 270 of the gate 27 to L, so that the gate 28 is turned on to thereby operate the alarm 31 again. Therefore, the operator knows that the alarm is set.

When the output of the hour and minute circuit 7 coincides with the output of the alarm setting circuit 12, the output Q23 of the flip-flop 23 goes to H. The output of the alarm inhibiting gate 20 becomes L, because at least one input of the gate 20 is L, whereby the output 520 of the inverter 52 goes to H. Accordingly, the gate 26 is turned on to produce the 250 ms signal on the output every 1 second, whereby the output 270 of the gate 27 becomes L. Thus, the alarm 31 is operated at the set time so that the gate 20 is operated and the output 520 of the inverter 52 goes to L. Thus, the gate 26 is turned off whereby the alarm stops making noise.

Figure 2:
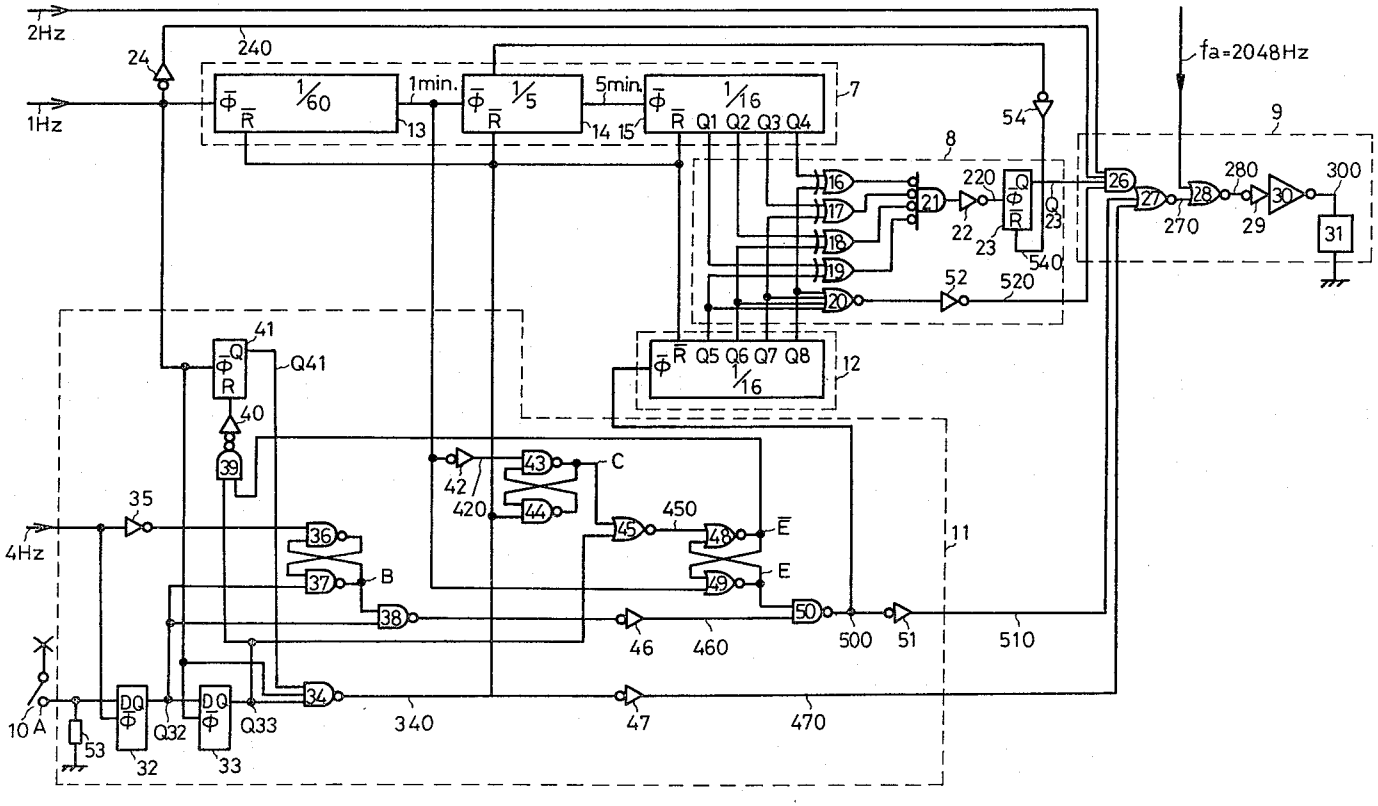
FIG. 2 is a diagram of a control circuit of the present invention.
Figure 3:
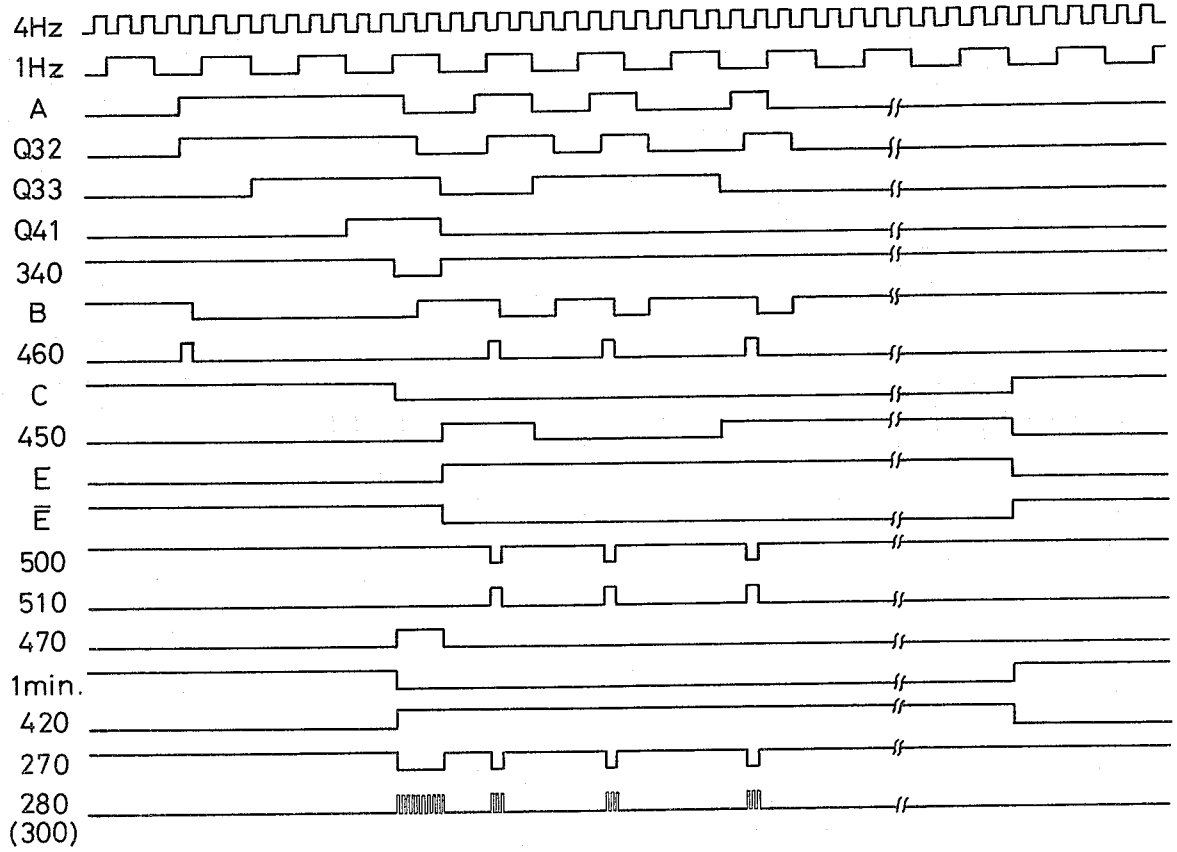
FIG. 3 shows waveforms of the circuit at various locations of FIG. 2.
Figure 4:
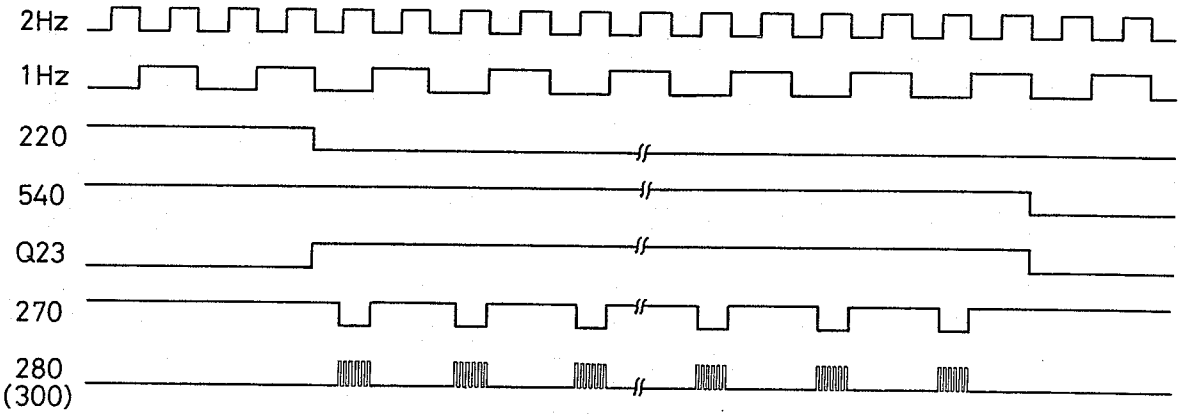
FIG. 4 shows waveforms of the circuit of FIG. 2 at the alarm set time.

Above described operation of the circuits of FIG. 2 will be more fully understood from the waveforms illustrated in FIGS. 3 and 4.

From the foregoing it will be understood that the present invention may provide an alarm means of which alarm may be easily and surely set by operating a single switch and which may generate various alarms to inform the operator that the alarm setting circuit is operated.

While a single embodiment has been described in detail herein, it will be apparent to those skilled in the art that various changes may be made without departing from the spirit or scope of the invention.

What is claimed is:

1. An analog electronic timepiece having a crystal controlled oscillator, a frequency divider for dividing the output of said oscillator and producing an output, a driving circuit connected to said frequency divider for producing a pulse signal, a motor operated by said pulse signal, and a hand display device driven by said motor for indicating the current time, the improvement comprising:

an hour and minute circuit including means for counting the output of said frequency divider to generate an elapsed time duration signal;

an alarm setting circuit including means for memorizing a desired elapsed time duration and providing an output signal indicative thereof, said alarm setting circuit having a reset state and an alarm set enabling state;

an equality checking circuit connected to said hour and minute circuit and said alarm setting circuit and adapted to produce an output signal when said elapsed time duration signal coincides with the output signal of said alarm setting circuit representing the desired elapsed time memorized;

an alarm device responsive to the output signal of said equality checking circuit;

a manually operated elapsed time setting switch having a single button and providing a plurality of time setting mode signals; and gate means responsive to said elapsed time setting switch for resetting and clearing said hour and minute circuit, said alarm setting circuit, and said alarm device by controlling the output of said frequency divider in accordance with the time setting mode signals produced by operating said switch, said gate means further setting said alarm setting circuit in response to said time setting mode signals.

2. An analog electronic timepiece according to claim 1, wherein said gate means produces a signal for changing said alarm setting circuit to the alarm set enabling state when said switch is closed for a predetermined time.

3. An analog electronic timepiece according to claim 2, wherein said gate means produces a signal which actuates said alarm device simultaneous to the change of said alarm setting circuit to the alarm set enabling state.

4. An analog electronic timepiece according to claim 1, wherein said gate means produces a signal for actuating said alarm device in accordance with the closing of said switch.

5. An analog electronic timepiece according to claim 1, wherein said gate means produces a signal which resets said hour and minute circuit simultaneous to the change of said alarm setting circuit to the alarm set enabling state for a predetermined time and thereafter said gate means produces a signal which changes the hour and minute circuit to the counting state.

6. An analog electronic timepiece according to claim 1, wherein said gate means produces a signal which sets the alarm time in said alarm setting circuit in accordance with the closing of said switch.

7. An analog electronic timepiece according to claim 1, wherein said gate means prevents the alarm set signal from being applied to said alarm setting circuit after the predetermined time in which said alarm set enabling state exists.

8. An analog electronic timepiece according to claim 1, wherein said gate means produces a signal which cancels the operation of said alarm device when said switch is closed for a predetermined time.

9. An analog electronic timepiece having a crystal controlled oscillator, a frequency divider for dividing the output of said oscillator and producing an output, a driving circuit connected to said frequency divider for producing a pulse signal, a motor operated by said pulse signal, and a hand display device driven by said motor for indicating the current time, the improvement comprising:

an hour and minute circuit including means for counting the output of said frequency divider to generate an elapsed time duration signal;

an alarm setting circuit including means for memorizing a desired elapsed time duration and providing an output signal indicative thereof;

an equality checking circuit connected to said hour and minute circuit and said alarm setting circuit and adapted to produce an output signal when said elapsed time duration signal coincides with the output signal of said alarm setting circuit;

an alarm device responsive to the output signal of said equality checking circuit;

a manually operated elapsed time setting switch which provides a plurality of time setting mode signals; and gate means responsive to said elapsed time setting switch for resetting and clearing said hour and minute circuit, setting said alarm setting circuit, and de-energizing said alarm device by controlling the output of said frequency divider in accordance with the time setting mode signals produced by operating said switch.

* * * * *